US009302292B2

(12) United States Patent
Lin et al.

(10) Patent No.: US 9,302,292 B2
(45) Date of Patent: Apr. 5, 2016

(54) PIEZOELECTRIC ELECTROACOUSTIC TRANSDUCER

(71) Applicant: Industrial Technology Research Institute, Chutung, Hsinchu County (TW)

(72) Inventors: Chia-Hsin Lin, Chutung (TW); Ching-Iuan Sheu, Chutung (TW)

(73) Assignee: Industrial Technology Research Institute, Chutung (TW)

( * ) Notice: Subject to any disclaimer, the term of this patent is extended or adjusted under 35 U.S.C. 154(b) by 0 days.

(21) Appl. No.: 14/564,609

(22) Filed: Dec. 9, 2014

(65) Prior Publication Data

US 2015/0258574 A1 Sep. 17, 2015

(30) Foreign Application Priority Data

Mar. 14, 2014 (TW) ..... 103109381

(51) Int. Cl.

| | |
|---|---|
| ***H04R 25/00*** | (2006.01) |
| ***B06B 1/06*** | (2006.01) |
| ***H04R 17/00*** | (2006.01) |
| ***H04R 1/28*** | (2006.01) |
| *H04R 31/00* | (2006.01) |

(52) U.S. Cl.

CPC ..... *B06B 1/0644* (2013.01); *H04R 1/2869* (2013.01); *H04R 17/00* (2013.01); *H04R 31/00* (2013.01)

(58) Field of Classification Search

CPC ..... H04R 1/2869; H04R 17/00; H04R 31/00
USPC ..... 381/190
See application file for complete search history.

(56) References Cited

U.S. PATENT DOCUMENTS 5,594,292 A * 1/1997 Takeuchi ..... H04L 41/0973 310/324
5,825,902 A 10/1998 Fujishima (Continued)

FOREIGN PATENT DOCUMENTS

CN 1396752 A 2/2003
CN 1536931 A 10/2004

(Continued)

OTHER PUBLICATIONS

Kim et al., "A Piezoelectric Microspeaker with a High-Quality PMN-PT Single-Crystal Membrane," *J. Kor. Phys. Soc.*, 54(2):930-933 (2009).

(Continued)

*Primary Examiner* — Tuan D Nguyen
(74) *Attorney, Agent, or Firm* — McCarter & English, LLP; Yu Lu

(57) ABSTRACT

A piezoelectric electroacoustic transducer is provided, including a three-dimensional structure, at least a piezoelectric element, and at least a membrane. The three-dimensional structure is formed to have a top portion and a side portion integrally connected to the top portion by press molding a plate. The side portion has at least a gap and is separated into a plurality of pillars by the at least a gap. The at least a piezoelectric element is disposed on the top portion, and the at least a membrane covers the at least a gap of the side portion. The piezoelectric electroacoustic transducer in the present disclosure is capable of being implemented as a loudspeaker or a microphone.

12 Claims, 12 Drawing Sheets

(56) References Cited

U.S. PATENT DOCUMENTS

| | | | | |
|---|---|---|---|---|
| 6,064,746 | A | 5/2000 | Nakamura et al. | |
| 6,453,050 | B1 | 9/2002 | Ogura et al. | |
| 6,839,445 | B2 | 1/2005 | Kihara | |
| 6,865,785 | B2 | 3/2005 | Ogura et al. | |
| 6,888,947 | B2 | 5/2005 | Takeshima et al. | |
| 2001/0045792 | A1* | 11/2001 | Takeshima | H04R 1/06 310/340 |
| 2003/0021458 | A1* | 1/2003 | Hamada | B06B 1/0603 382/135 |
| 2004/0205949 | A1* | 10/2004 | Takeshima | H04R 17/00 29/25.35 |
| 2004/0218769 | A1 | 11/2004 | Kami et al. | |
| 2012/0008805 | A1 | 1/2012 | Hachinohe et al. | |
| 2014/0058297 | A1* | 2/2014 | Clark | A61N 7/02 601/3 |

FOREIGN PATENT DOCUMENTS

| | | | |
|---|---|---|---|
| CN | 1571581 | A | 1/2005 |
| CN | 1843058 | A | 10/2006 |
| CN | 1313020 | A | 5/2007 |
| CN | 100358394 | C | 12/2007 |
| CN | 101313628 | A | 11/2008 |
| CN | 100496057 | C | 6/2009 |
| CN | 101448192 | A | 6/2009 |
| CN | 100525512 | C | 8/2009 |
| CN | 201718027 | U | 1/2011 |
| CN | 201750546 | U | 2/2011 |
| CN | 102547541 | A | 7/2012 |
| CN | 102823275 | A | 12/2012 |
| EP | 0999723 | A2 | 5/2000 |
| JP | 6022394 | A | 2/1985 |
| JP | 60165200 | A | 8/1985 |
| JP | 9271096 | A | 10/1997 |
| JP | 11331976 | A | 11/1999 |
| JP | 2001016692 | A | 1/2001 |
| JP | 2001285994 | A | 10/2001 |
| JP | 2005064831 | A | 3/2005 |
| JP | 2012134592 | A | 7/2012 |
| TW | I325729 | B | 6/2010 |
| TW | M409665 | U | 8/2011 |

OTHER PUBLICATIONS

Kim et al., "High Performance Piezoelectric Microspeakers and Thin Speaker Array System," *ETRI Journal*, 31(6):680-687 (2009).

Ko et al., "Piezoelectric Membrane Acoustic Devices," *IEEE*, The Fifteenth International Conference on Micro Electro Mechanical Systems, pp. 296-299 (2002).

Lee et al., "Piezoelectric Cantilever Microphone and Microspeaker," *J. Microelectromechanical Systems*, 5(4):238-242 (1996).

Yi and Kim, "Piezoelectric microspeaker with compressive nitride diaphragm," The 15th IEEE International Conference on Micro Electro Mechanical Systems, pp. 260-263 (2002).

CN 100358394C (1536931A) English abstract.
CN 100496057C (1396752A) English abstract.
CN 100525512C (1571581A) English abstract.
CN 1 01 31 3628 English abstract.
CN 101448192A English abstract.
CN 102547541 English abstract.
CN 102823275A English abstract.
CN 1313020A English abstract.
CN 1843058A English abstract.
CN 201718027U English abstract.
CN 201750546U English abstract.
JP 11331976 English abstract.
JP 2001016692 English abstract.
JP 2001285994 English abstract.
JP 2005064831 English abstract.
JP 2012134592 English abstract.
JP 60165200 English abstract.
JP 6022394A English abstract.
JP 9271096 English abstract.
TW 1325729 English abstract.
TW M409665U1 English abstract.

* cited by examiner

PIEZOELECTRIC ELECTROACOUSTIC TRANSDUCER

CROSS-REFERENCE TO RELATED APPLICATIONS

This application claims foreign priority under 35 U.S.C. §119(a) to Patent Application No. 103109381, filed on Mar. 14, 2014, in the Intellectual Property Office of Ministry of Economic Affairs, Republic of China (Taiwan, R.O.C.), the entire content of which Patent Application is incorporated herein by reference and made a part of this specification.

BACKGROUND OF THE INVENTION

1. Technical Field

The present disclosure relates to transducers, and, more particularly, to a piezoelectric electro acoustic transducer.

2. Description of Related Art

A piezoelectric speaker as known is used to convert mechanical energy into electrical energy. When AC power is applied to the piezoelectric speaker, a piezoelectric element deforms and drives a membrane closed attached thereto to vibrate so as to compress air for producing sounds.

The membrane with the piezoelectric element is fixed on a supporting structure or a frame by a bonding material. However, the piezoelectric speaker as mentioned above shows a lower sound pressure level, since the vibration energy may be wasted or a part of the vibration energy may be converted into thermal energy and irregular tremble during transmitting through the membrane, the bonding material, and the frame. Furthermore, the membrane is fixed on the frame and such a fixed structure will generate a mechanical resonance, this results an uneven sound pressure level (i.e., ripple) and distortion phenomenon.

Ripple and distortion are important sound quality factors for a speaker. When a mechanical resonance occurs in the speaker, vibrations arise in a fundamental frequency and its multiples, thereby a sound pressure produced by the speaker would increase in resonance frequency bands and the sound pressure decreases while a distortion increases in non-resonance frequency bands. Also, an excessive ripple and the distortion cause a discordant sensation of sound.

Currently, most piezoelectric speakers are consisted of a piezoelectric element, a bonding material (or buffer), and a frame by various physical or chemical assembling manner. Such speakers not only complicate structures but also reduce energy transition efficiency and sound pressure. On the other hand, there are ripples in sound pressure level curvature and distortion phenomenon due to the obvious mechanical resonance.

Therefore, how to overcome the above-described drawbacks has become urgent.

SUMMARY OF THE INVENTION

The present disclosure provides a piezoelectric electroacoustic transducer, comprising: a three-dimensional structure including a top portion and a side portion integrally connected to the top portion, wherein the side portion has at least a gap; at least a piezoelectric element provided on the top portion; and at least a membrane covering the at least a gap of the side portion.

In an embodiment, the three-dimensional structure is formed to have the top portion and the side portion integrally connected to the top portion by press molding a plate, and the side portion is separated into a plurality of pillars by the at least a gap.

The piezoelectric electroacoustic transducer in the present disclosure may exhibit a speaker characteristic for high sound pressure level, flat sound pressure level curvature, and low THD, as well as a microphone function for converting sound wave to electronic signal.

BRIEF DESCRIPTION OF THE DRAWINGS

The disclosure can be more fully understood by reading the following detailed description of the preferred embodiments, with reference made to the accompanying drawings.

DETAILED DESCRIPTION OF THE INVENTION

Figure 1A:
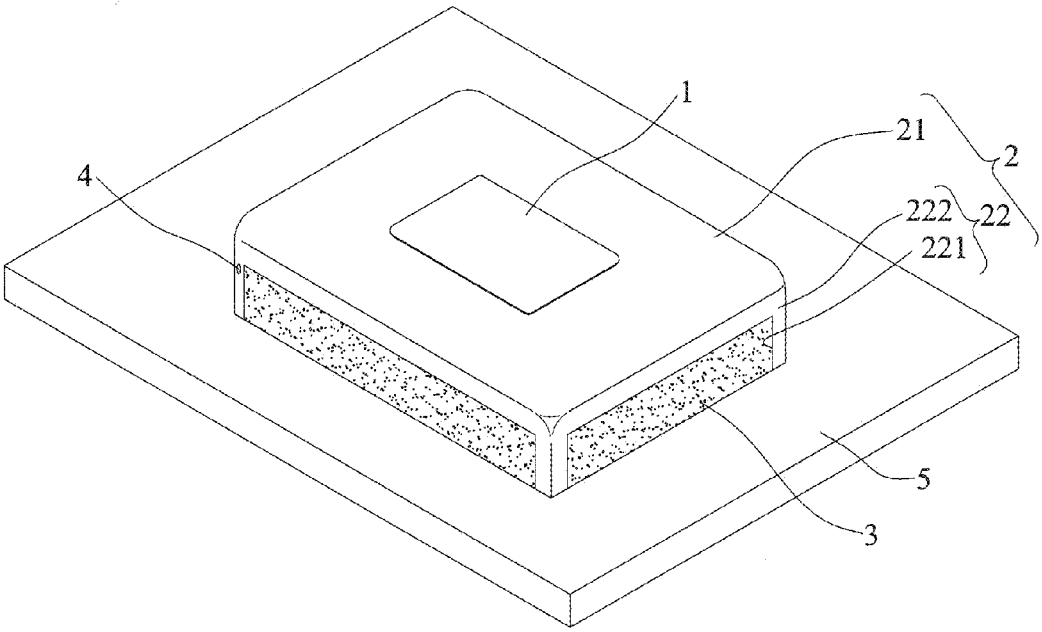
FIG. 1A is a perspective view of a piezoelectric electroacoustic transducer according to an embodiment 1 of the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Referring to FIGS. 1 to 10, a piezoelectric electroacoustic transducer according to the present disclosure has a piezoelectric element 1, a three-dimensional structure 2, and a membrane 3.

The three-dimensional structure 2 includes a top portion 21 and a side portion 22 integrally connected to the top portion 21. The top portion 21 has an inner surface 212 and an outer surface 211 opposing the inner surface. The top portion 21 is rectangular as illustrated in FIGS. 1A to 6, circular as illustrated in FIGS. 7 to 10, elliptical, or any other shape. The side portion 22 has at least a gap 221 and is separated into a plurality of pillars 222 by the at least a gap 221. In an embodiment, the side portion 22 has 3 to 24, preferably 4 to 8 pillars 222. The pillar 222 has a width within a range of 2 mm to 6 mm and is rectangular as illustrated in FIG. 1A, triangular as illustrated in FIG. 2A, trapezoid as illustrated in FIGS. 3 to 10, or any other shape. In addition, in an embodiment, an angle between the top portion 21 and the side portion 22 is within 60 to 120 degrees, preferably within 75 to 105 degrees.

Figure 1B:
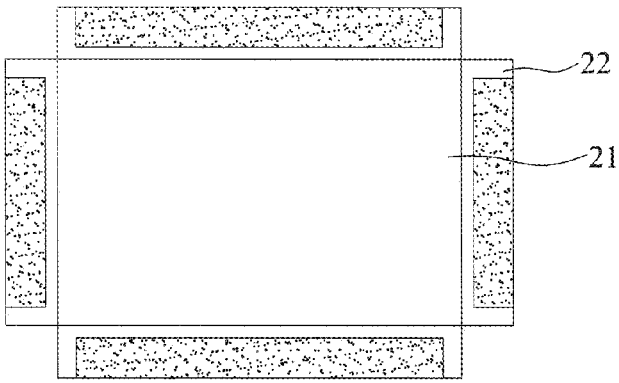
FIG. 1B is a schematic view of a three-dimensional structure before press molding of a piezoelectric electroacoustic transducer according to an embodiment 1 of the present disclosure.
Figure 2A:
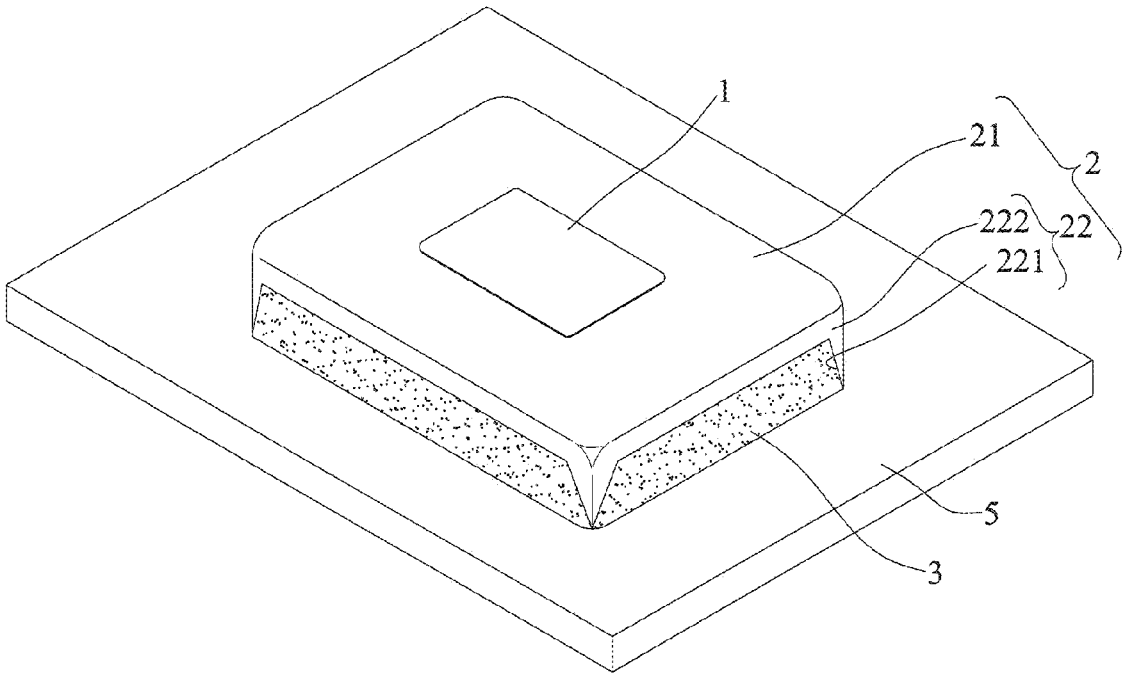
FIG. 2A is a perspective view of a piezoelectric electroacoustic transducer according to an embodiment 2 of the present disclosure.

It should be noted that the three-dimensional structure 2 is a plate originally, as illustrated in FIG. 1B. The three-dimensional structure 2, as illustrated in FIG. 1A, is formed by press molding the plate. The three-dimensional structure 2 is mainly made of a metal plate or a sandwich composite consisting of a metal plate, a polymer film and a metal plate in series and having a thickness within a range of 30 μm to 200 μm.

The piezoelectric element 1 is provided on the top portion 21 and may be attached to at least one of the inner surface 212 or the outer surface 211. The piezoelectric element 1 is rectangular as illustrated in FIGS. 1A to 6, circular as illustrated in FIGS. 7 to 10, elliptical, or any other shape. For instance, the piezoelectric element 1 is a piezoelectric ceramic actuator.

Figure 2B:
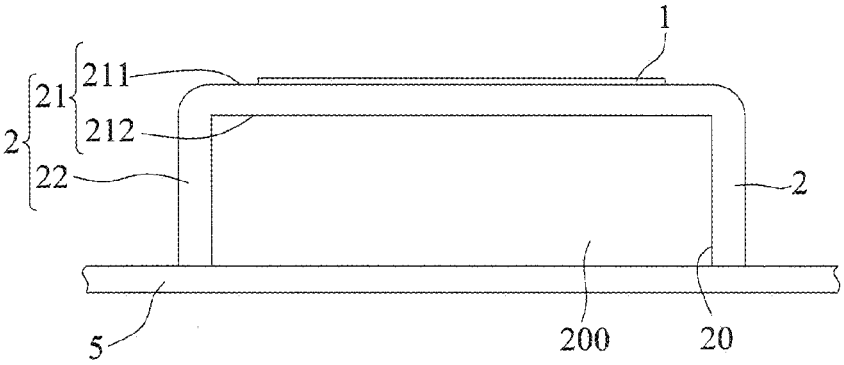
FIG. 2B is a cross-sectional view of a piezoelectric electroacoustic transducer according to an embodiment 2 of the present disclosure.
Figure 3:
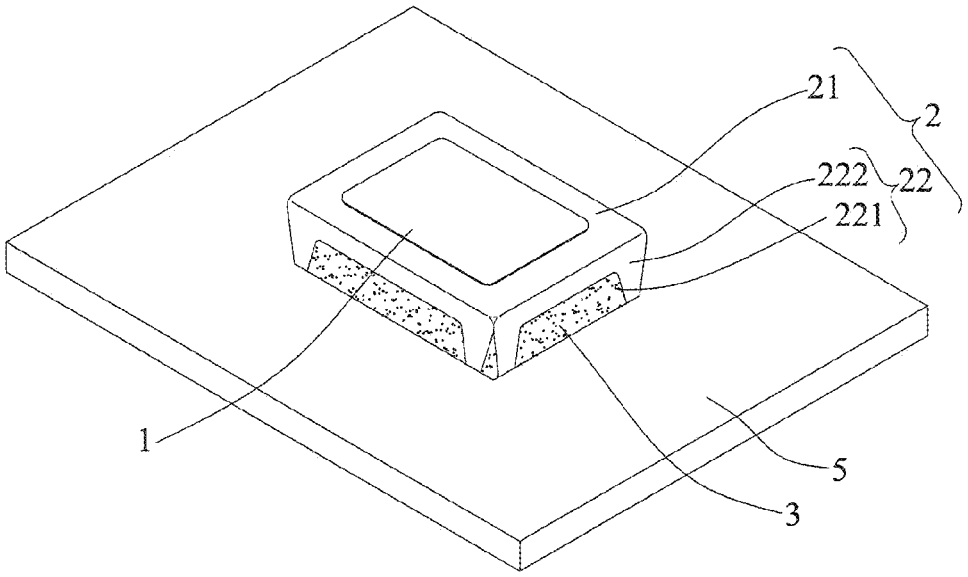
FIG. 3 is a perspective view of a piezoelectric electroacoustic transducer according to an embodiment 3 of the present disclosure.
Figure 4:
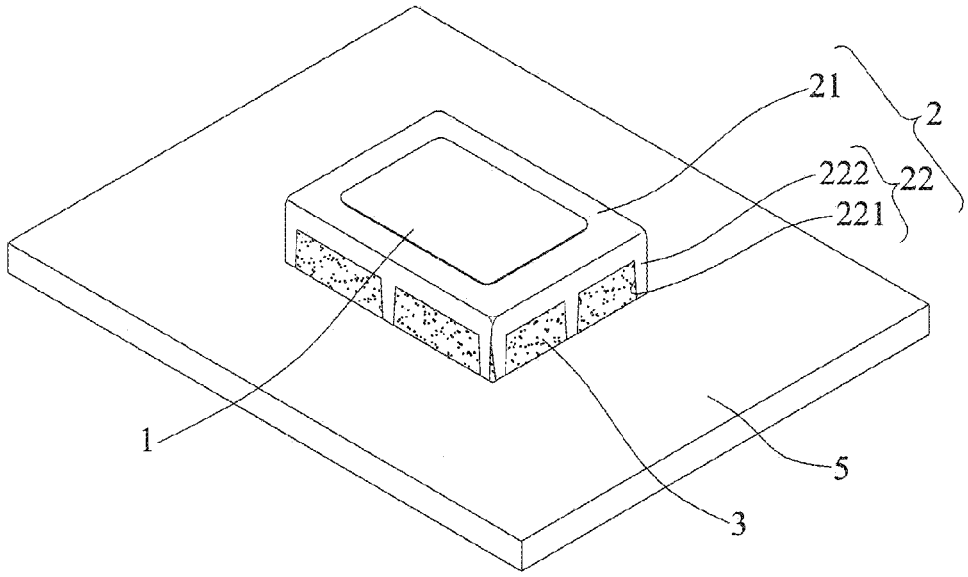
FIG. 4 is a perspective view of a piezoelectric electroacoustic transducer according to an embodiment 4 of the present disclosure.
Figure 5:
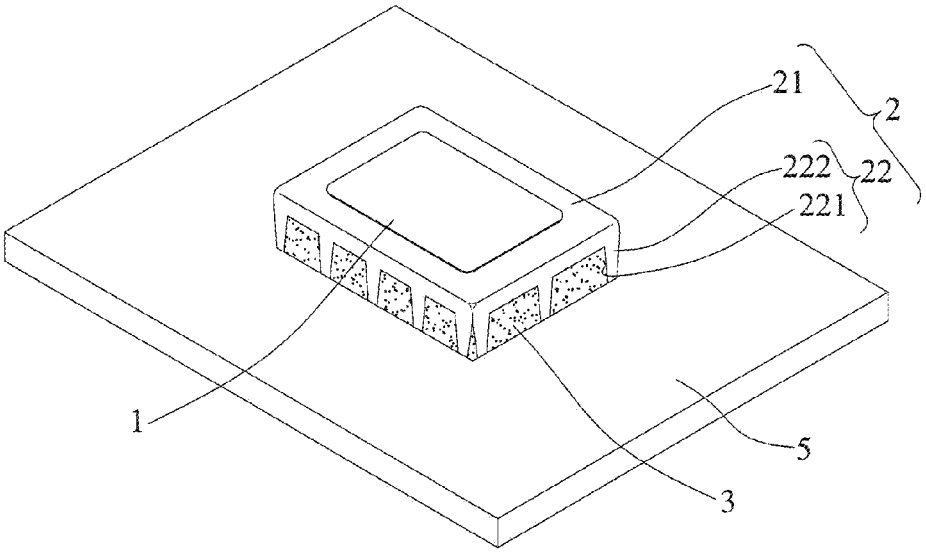
FIG. 5 is a perspective view of a piezoelectric electroacoustic transducer according to an embodiment 5 of the present disclosure.
Figure 6:
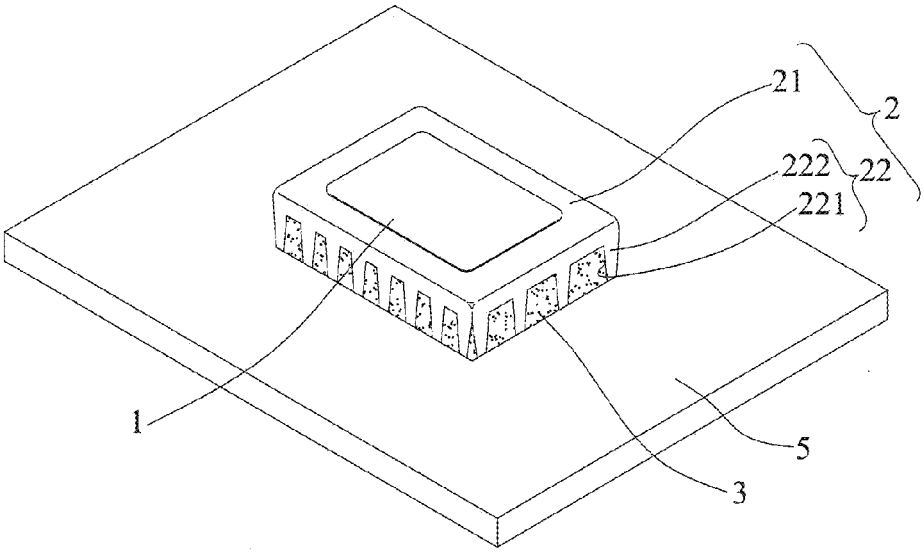
FIG. 6 is a perspective view of a piezoelectric electroacoustic transducer according to an embodiment 6 of the present disclosure.
Figure 7:
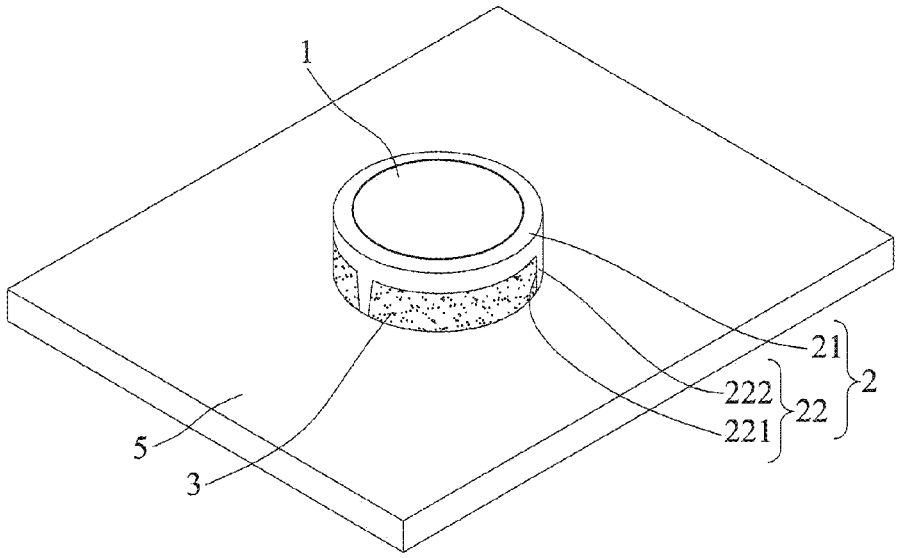
FIG. 7 is a perspective view of a piezoelectric electroacoustic transducer according to an embodiment 11 of the present disclosure.
Figure 8:
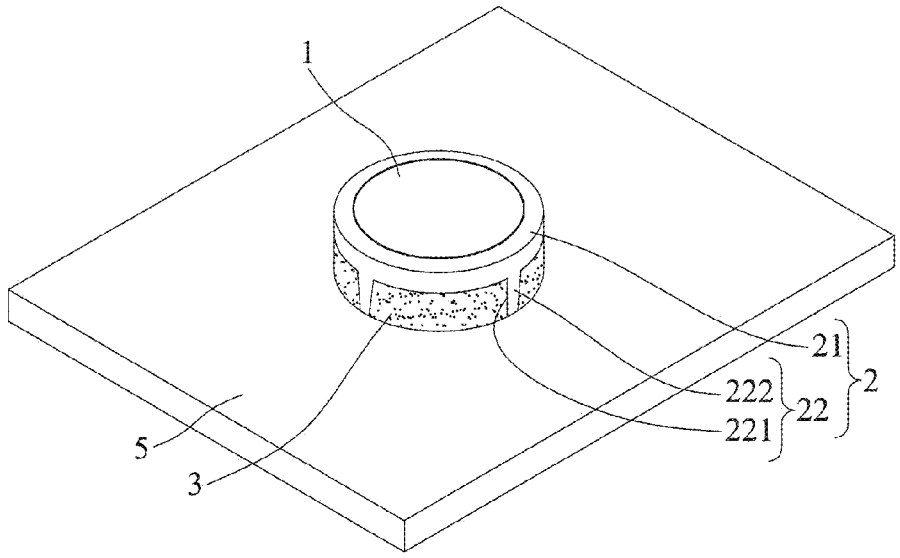
FIG. 8 is a perspective view of a piezoelectric electroacoustic transducer according to an embodiment 12 of the present disclosure.
Figure 9:
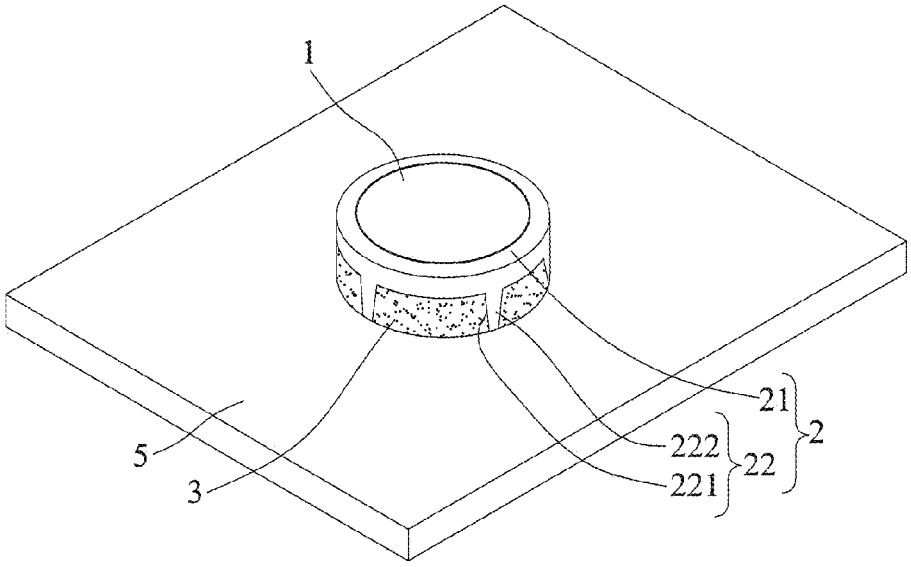
FIG. 9 is a perspective view of a piezoelectric electroacoustic transducer according to an embodiment 13 of the present disclosure.
Figure 10:
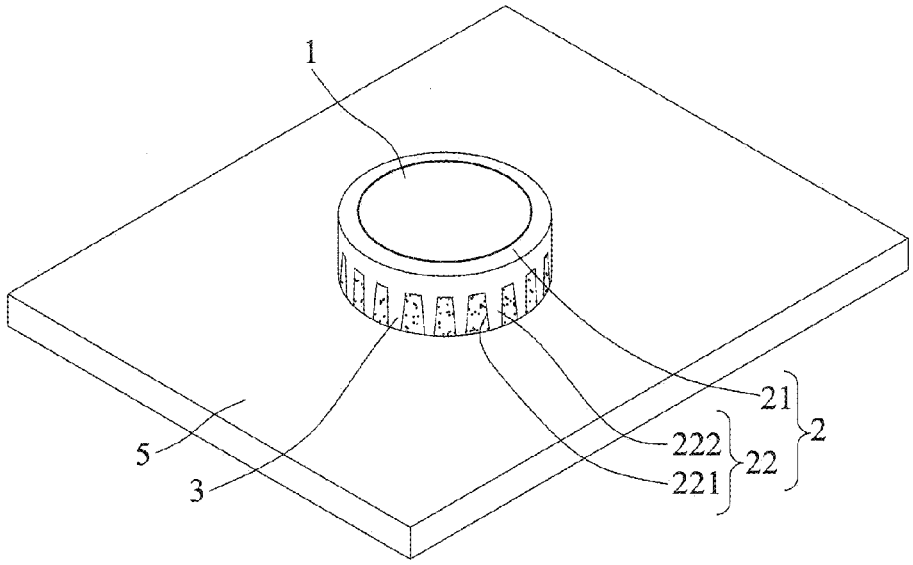
FIG. 10 is a perspective view of a piezoelectric electroacoustic transducer according to an embodiment 14 of the present disclosure.

The membrane 3 covers the at least one gap 211 of the side portion 22 so as to form an approximate closed cavity constituted by the side portion 22 and the top portion 21, i.e., a cavity 20 including an opening 200, as illustrated FIG. 2B, or a cavity including no opening in another embodiment. The membrane 3 is made of organic macromolecule and has a thickness within a range of 10 μm to 300 μm.

In an embodiment, the piezoelectric electroacoustic transducer in the present disclosure further comprises at least one through hole 4 formed on the top portion 21, the side portion 22, or the membrane 3.

In an embodiment, the piezoelectric element 1 is attached to a portion having the maximum area of the three-dimensional structure 2, i.e., the top portion 21. The top portion 21 is formed to have slight curvature, preferable within 0 to 15 degrees, such that a pre-stress exists in the three-dimensional structure 2 and the side portion 22 is formed to have a plurality of pillars 222, therefore reducing the resonance of the three-dimensional structure 2. In an embodiment, the piezoelectric electroacoustic transducer is fixed on a substrate 5 with foam rubber or silicone rubber, by providing a portion with the opening 200 of the three-dimensional structure 2 on the substrate 5 in the case of the piezoelectric electroacoustic transducer including the opening 200. When acting the piezoelectric element 1, vibration energy could transmit effectively from the piezoelectric element 1 to the entire three-dimensional structure 2 encompassing all pillars 222 due to the pre-stress existed in the three-dimensional structure 2.

Comparative example and embodiments 1 to 14 are illustrated as follows.

Figure 11:
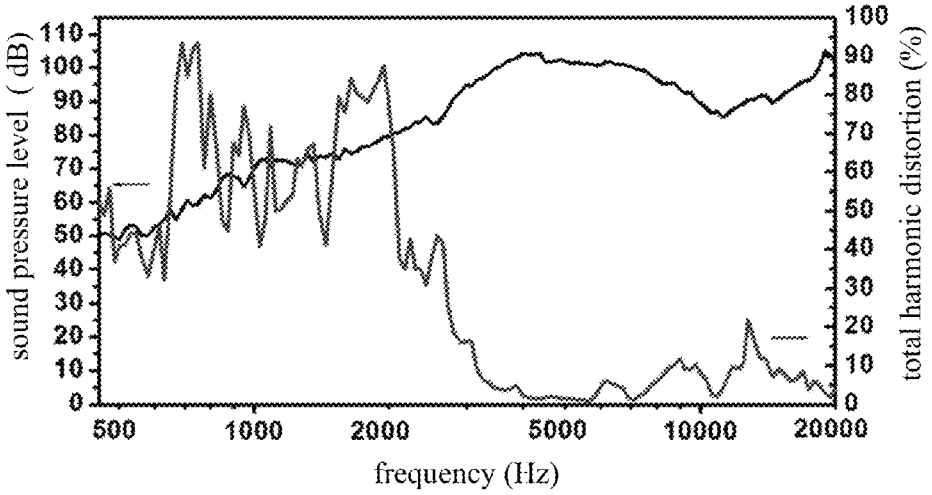
FIG. 11 is a diagram showing the sound pressure level and total harmonic distortion of a piezoelectric electroacoustic transducer according to a comparative example of the present disclosure.

Comparative example: a flat plate (about 50 mm×50 mm) with a piezoelectric element (about 40 mm×20 mm×0.05 mm) attached to thereon is adhered in a frame (about 55 mm×30 mm inside) by silicon gel. The flat plate is zinc-copper alloys in a thickness of about 50 μm. As the piezoelectric electroacoustic transducer in this example is implemented as a speaker, an electrical parameter for testing is 10 Vrms and a microphone for receiving sound located 10 cm away. The testing results for the sound pressure level and the total harmonic distortion in the comparative example are shown in FIG. 11.

Figure 12:
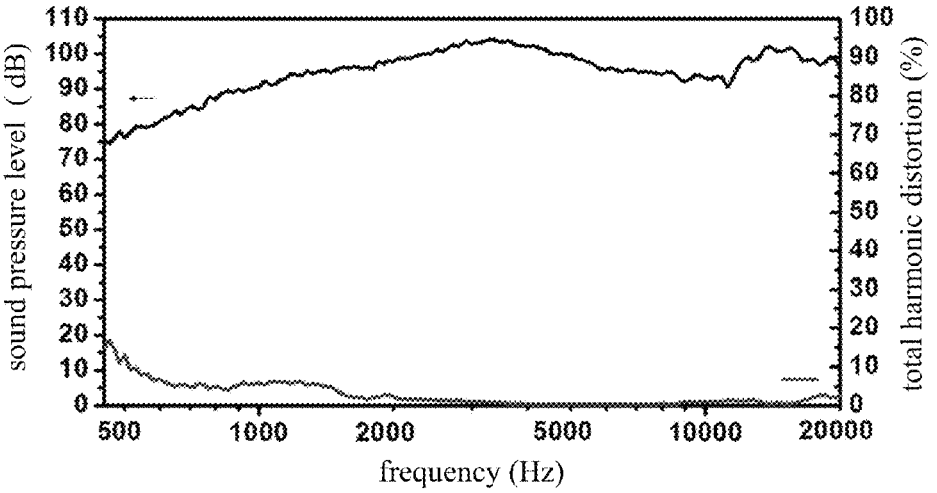
FIG. 12 is a diagram showing the sound pressure level and total harmonic distortion of a piezoelectric electroacoustic transducer according to an embodiment 1 of the present disclosure.

Embodiment 1: the piezoelectric element is rectangular (about 54 mm×19 mm×0.05 mm), the top portion of the three-dimensional structure is rectangular (about 64 mm×32 mm×3 mm), the side portion of the three-dimension structure has four rectangular pillars, and the pillars are perpendicular to the top portion. The three-dimensional structure is a composite sandwich sheet made of zinc-copper alloy, polymer and zinc-copper alloy in series and has a thickness of 110 μm. As the piezoelectric electroacoustic transducer in this embodiment is implemented as a speaker, an electrical parameter for testing is 10 Vrms and a microphone for receiving sound located 10 cm away. The testing results for the sound pressure level and the total harmonic distortion in the embodiment 1 are shown in FIG. 12.

Figure 13:
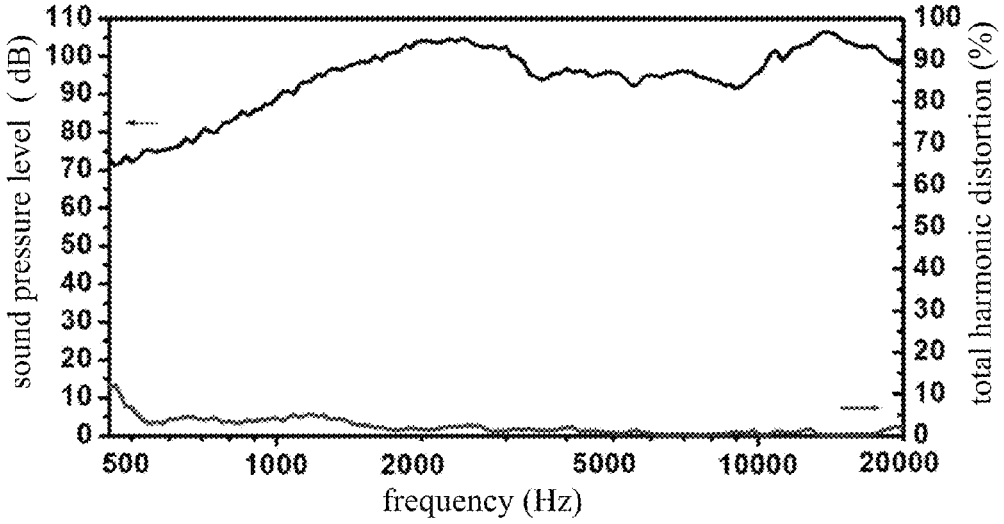
FIG. 13 is a diagram showing the sound pressure level and total harmonic distortion of a piezoelectric electroacoustic transducer according to an embodiment 2 of the present disclosure.

Embodiment 2: the difference between embodiments 2 and 1 is that the pillars in embodiment 2 are triangular. The testing results for the sound pressure level and the total harmonic distortion in the embodiment 2 are shown in FIG. 13.

Figure 14:
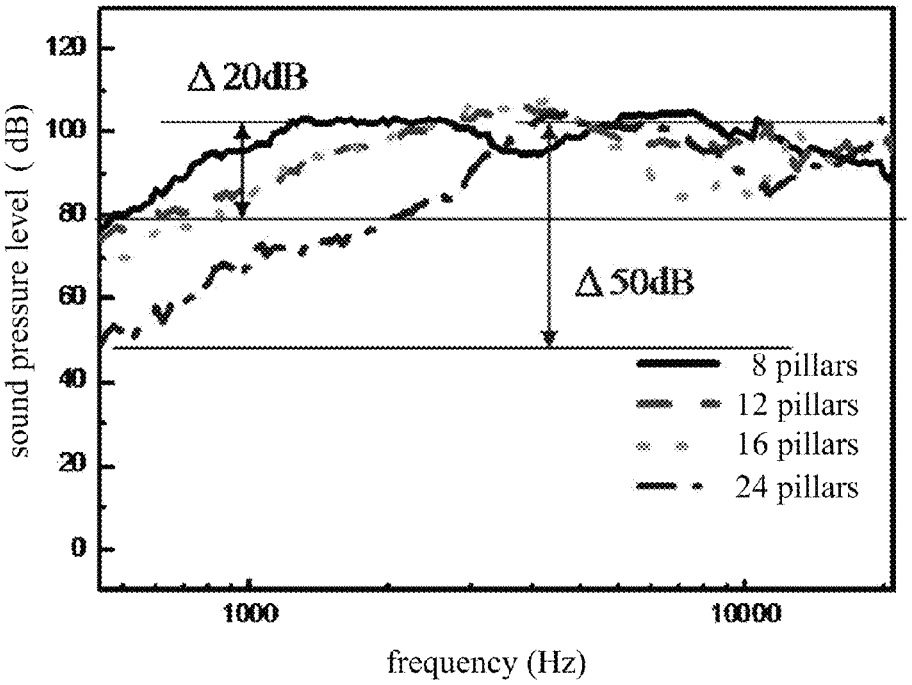
FIG. 14 is a diagram showing the sound pressure level of a piezoelectric electroacoustic transducer according to embodiments 3, 4, 5, and 6 of the present disclosure.
Figure 15:
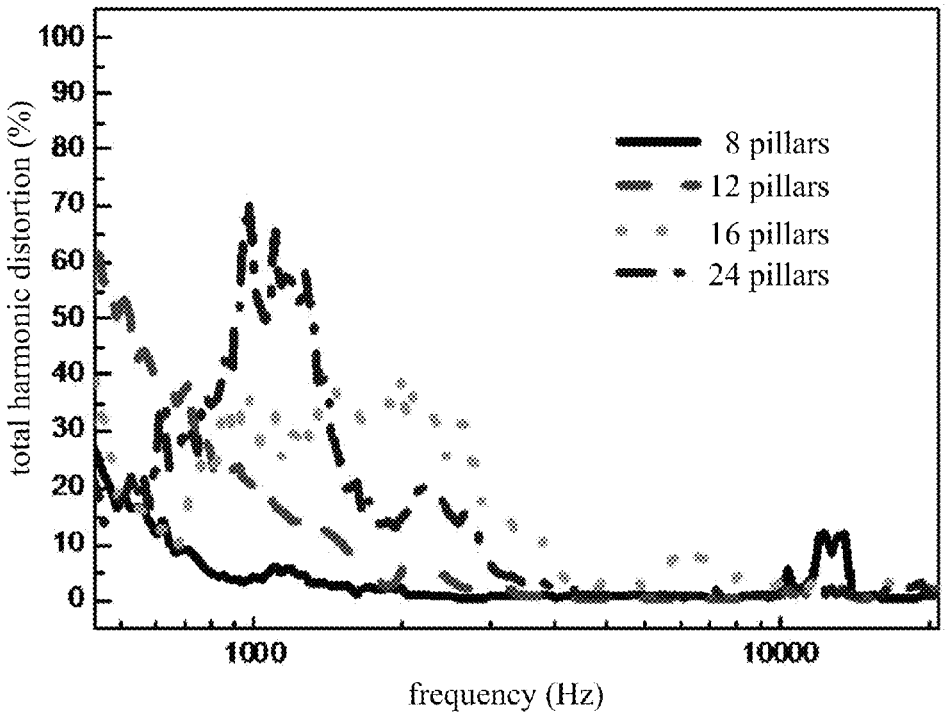
FIG. 15 is a diagram showing the total harmonic distortion of a piezoelectric electroacoustic transducer according to embodiments 3, 4, 5, and 6 of the present disclosure.

Embodiment 3: the difference between embodiments 3 and 1 is that the side portion in embodiment 3 has eight trapezoid pillars and a thickness of 2 mm. The testing results for the sound pressure level and the total harmonic distortion in the embodiment 3 are shown in FIGS. 14 and 15, respectively.

Embodiment 4: the difference between embodiments 4 and 3 is that the side portion in embodiment 4 has 12 pillars. The testing results for the sound pressure level and the total harmonic distortion in the embodiment 4 are shown in FIGS. 14 and 15, respectively.

Embodiment 5: the difference between embodiments 5 and 3 is that the side portion in embodiment 5 has 16 pillars. The testing results for the sound pressure level and the total harmonic distortion in the embodiment 5 are shown in FIGS. 14 and 15, respectively.

Embodiment 6: the difference between embodiments 6 and 3 is that the side portion in embodiment 6 has 24 pillars. The testing results for the sound pressure level and the total harmonic distortion in the embodiment 6 are shown in FIGS. 14 and 15, respectively.

Figure 16:
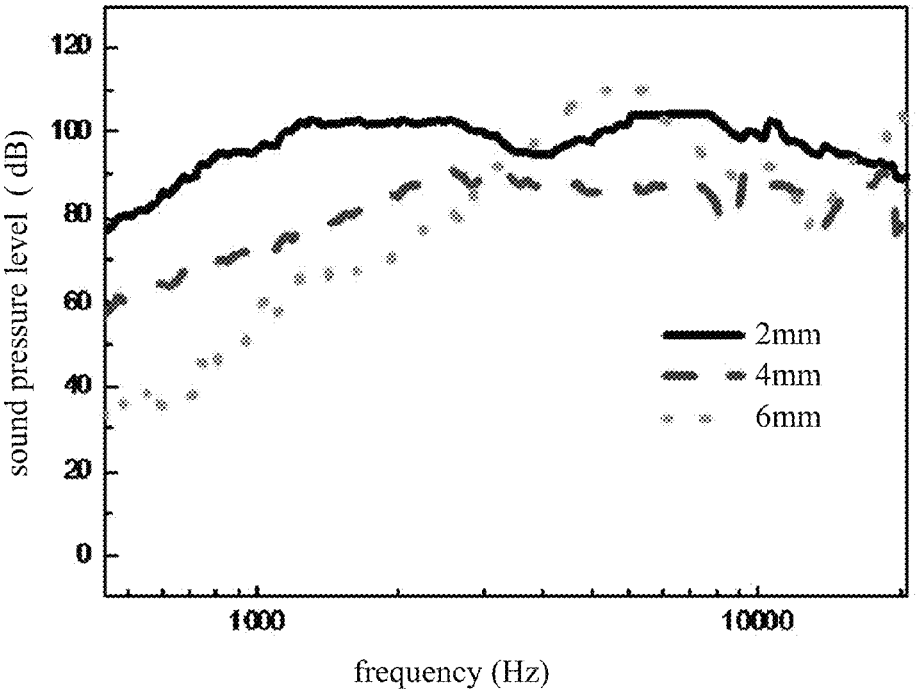
FIG. 16 is a diagram showing the sound pressure level of a piezoelectric electroacoustic transducer according to embodiments 3, 7, and 8 of the present disclosure.
Figure 17:
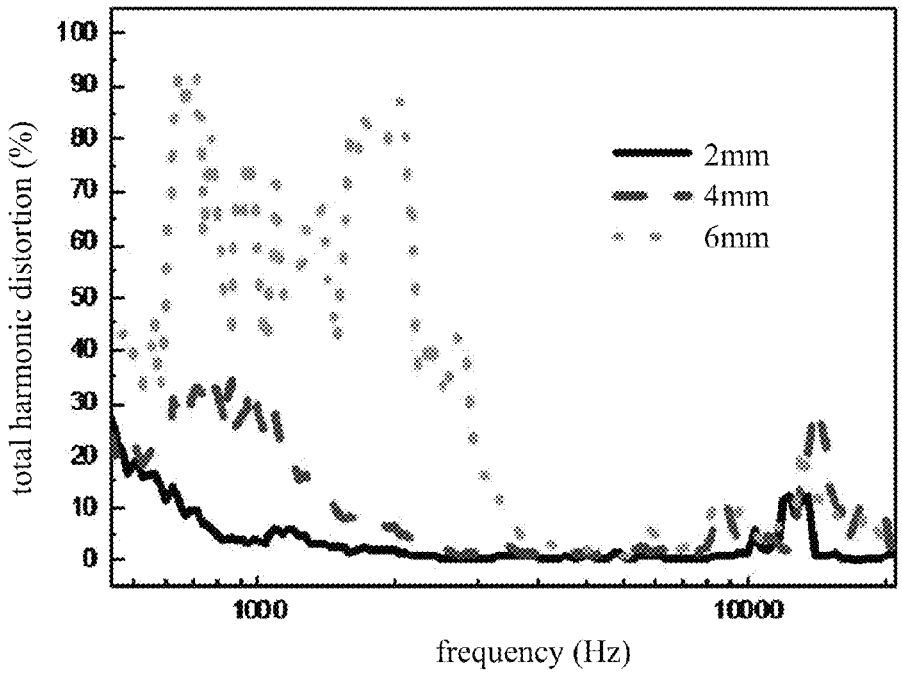
FIG. 17 is a diagram showing the total harmonic distortion of a piezoelectric electroacoustic transducer according to embodiments 3, 7, and 8 of the present disclosure.

Embodiment 7: the difference between embodiments 4 and 3 is that the pillars in embodiment 7 are 4 mm wide. The testing results for the sound pressure level and the total harmonic distortion in the embodiment 7 are shown in FIGS. 16 and 17, respectively.

Embodiment 8: the difference between embodiments 8 and 3 is that the pillars in embodiment 8 are 6 mm wide. The testing results for the sound pressure level and the total harmonic distortion in the embodiment 8 are shown in FIGS. 16 and 17, respectively.

Figure 18:
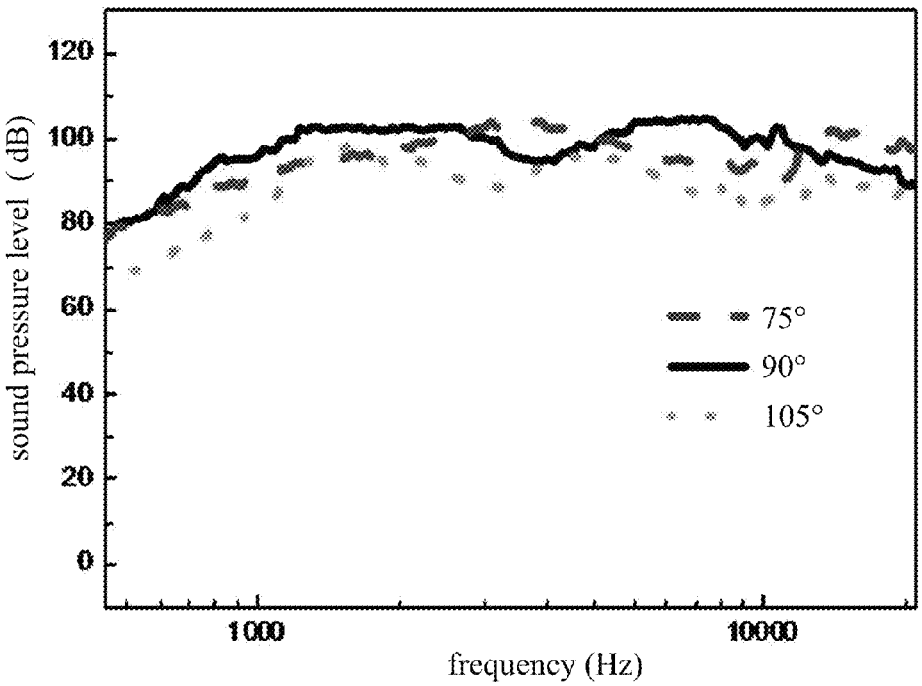
FIG. 18 is a diagram showing the sound pressure level of a piezoelectric electroacoustic transducer according to embodiments 3, 9, and 10 of the present disclosure.
Figure 19:
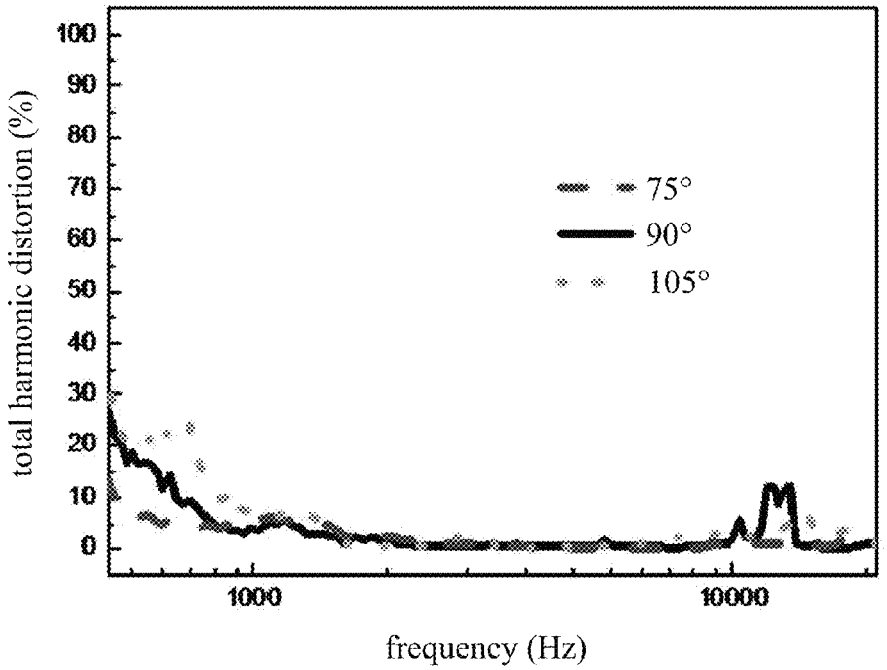
FIG. 19 is a diagram showing the total harmonic distortion of a piezoelectric electroacoustic transducer according to embodiments 3, 9, and 10 of the present disclosure.

Embodiment 9: the difference between embodiments 9 and 3 is an angle between the pillars and the tip portion in embodiment 9 is 75 degrees. The testing results for the sound pressure level and the total harmonic distortion in the embodiment 9 are shown in FIGS. 18 and 19, respectively.

Embodiment 10: the difference between embodiments 10 and 3 is the angle between the pillars and the tip portion in embodiment 10 is 105 degrees. The testing results for the sound pressure level and the total harmonic distortion in the embodiment 10 are shown in FIGS. 18 and 19, respectively.

Figure 20:
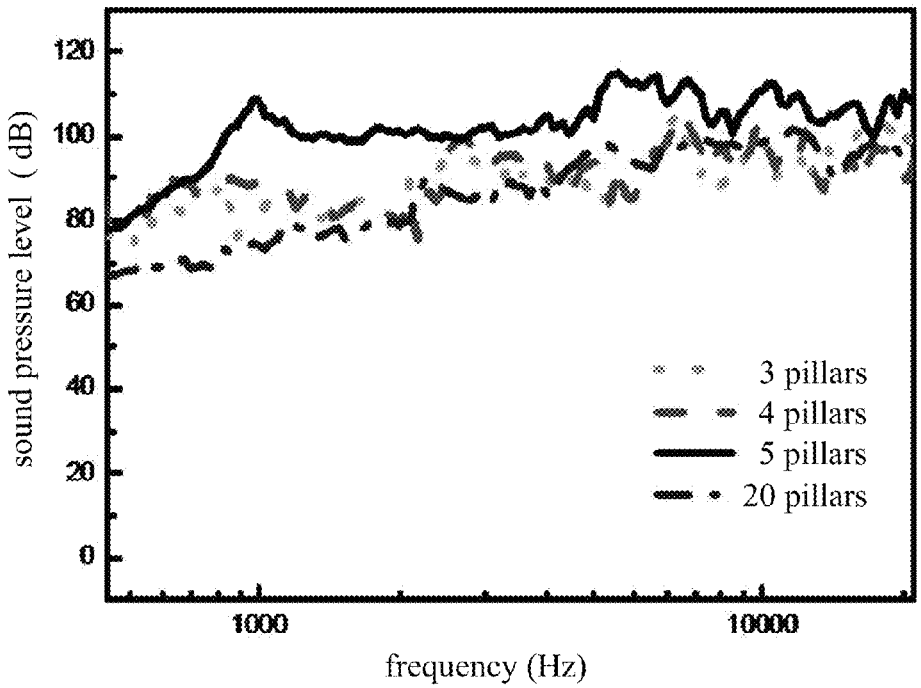
FIG. 20 is a diagram showing the sound pressure level of a piezoelectric electroacoustic transducer according to embodiments 11, 12, 13, and 14 of the present disclosure.
Figure 21:
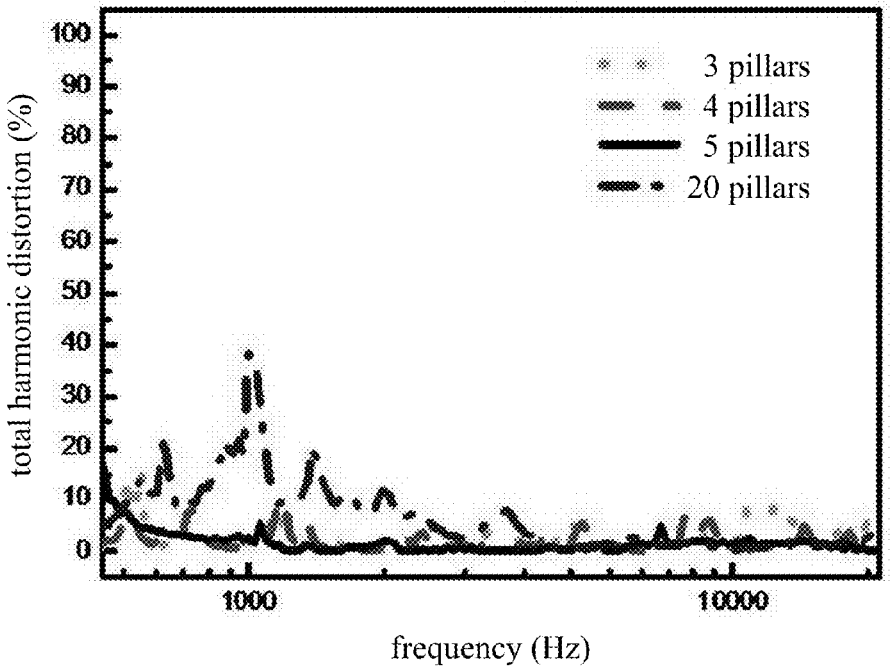
FIG. 21 is a diagram showing the total harmonic distortion of a piezoelectric electroacoustic transducer according to embodiments 11, 12, 13, and 14 of the present disclosure.

Embodiment 11: the difference between embodiments 9 and 3 is that the piezoelectric element in embodiment 11 is circular (about $\phi$35 mm×0.05 mm), the top portion is circular (about $\phi$50 mm×3 mm), and the side portion has three pillars. The testing results for the sound pressure level and the total harmonic distortion in the embodiment 11 are shown in FIGS. 20 and 21, respectively.

Embodiment 12: the difference between embodiments 12 and 11 is that the side portion in embodiment 12 has four pillars. The testing results for the sound pressure level and the total harmonic distortion in the embodiment 12 are shown in FIGS. 20 and 21, respectively.

Embodiment 13: the difference between embodiments 13 and 11 is that the side portion in embodiment 13 has five pillars. The testing results for the sound pressure level and the total harmonic distortion in the embodiment 13 are shown in FIGS. 20 and 21, respectively.

Embodiment 14: the difference between embodiments 14 and 11 is that the side portion in embodiment 14 has 20 pillars. The testing results for the sound pressure level and the total harmonic distortion in the embodiment 14 are shown in FIGS. 20 and 21, respectively.

The following are detailed description for the testing results for the comparative example and embodiments 1 to 14 as mentioned above.

Referring to FIG. 11, the sound pressure level (SPL) of the piezoelectric electroacoustic transducer in comparative example shows significant ripples, and a SPL drop may achieve 40 dB. The total harmonic distortion (THD) of the piezoelectric electroacoustic transducer in comparative example may be up to 80%.

Referring to FIG. 12, the SPL in embodiment 1 has a flat curvature, and the SPL drop is 5 dB. The corresponding THD in a resonance frequency of as high as 20 KHz may be below 5%.

Referring to FIG. 13, the SPL in embodiment 2 has a flat curvature, and the SPL drop is 5 dB. The corresponding THD in a resonance frequency of as high as 20 KHz may be below 5%.

It is known from FIGS. 11 to 13 that the piezoelectric electroacoustic transducer without fixing frame demonstrated in the present disclosure has good acoustic characteristics included high SPL, low THD and flat SPL curvature as compared to the prior art.

Referring to FIG. 14, the SPL in high frequency (about 3 KHz to 20 KHz) in embodiments 3 to 6 are not distinct. The SPL in low frequency (about 0.4 KHz to 3 KHz) is higher as the pillars are decreased and is lower as the pillars are increased. The SPL drop in entire frequency in embodiment 3 is only 20 dB while in embodiment 6 is up to 50 dB. In addition, referring to FIG. 15, the corresponding THD in low frequency is lower as the pillars are decreased.

It is known from FIGS. 14 to 15 that the piezoelectric electroacoustic transducer with eight pillars in embodiment 3 has preferable SPL and THD.

Referring to FIG. 16, the SPL in entire frequency (about 0.4 KHz to 20 KHz) in embodiments 3, 7 and 8 are distinct. The average of SPL in entire frequency is highest when pillars are narrowest, and the SPL (particularly in low frequency) is lower as the pillars are wider. In addition, referring to FIG. 17, the corresponding THD in entire frequency is lower as the pillars are narrower and is higher as the pillars are wider.

It is known from FIGS. 16 to 17 that the piezoelectric electroacoustic transducer with 8 pillars of a width of 2 mm in embodiment 3 has preferable SPL and THD.

Referring to FIG. 18, the SPL in entire frequency (about 0.4 KHz to 20 KHz) in embodiments 3, 9, and 10 are not distinct. In addition, referring to FIG. 19, the corresponding THD in most frequency is below 10%.

It is known from FIGS. 14 to 19, a three-dimensional structure with fewer and narrower pillars allows the piezoelectric electroacoustic transducer according to the present disclosure has lower stiffness, and that is, there exists smooth displacement and deformation from the top portion to the side portion so that the piezoelectric electroacoustic transducer in the present disclosure shows preferable SPL and THD characteristics.

Referring to FIG. 20, it shows the SPL of the piezoelectric electroacoustic transducer with a circular piezoelectric element and a circular top portion, which has similar results with piezoelectric electroacoustic transducer with a rectangular piezoelectric element and a rectangular top portion. The SPL of the piezoelectric electroacoustic transducer with fewer pillars is higher in low frequency and the SPL of the piezoelectric electroacoustic transducer with more pillars is lower in low frequency. In addition, referring to FIG. 21, the corresponding THD (particularly in entire frequency) is lower as the pillars are fewer and is higher as the pillars are more.

It is known from embodiments 1 to 14 of FIGS. 12-21 that, as compared with the prior art, the piezoelectric electroacoustic transducer according to the present disclosure shows smooth SPL curvature and low THD characteristics since it comprises a three-dimensional structure having a top portion and a side portion integrally connected to the top portion, and a membrane covering a gap in the side portion. In addition, the width and number of the pillars, rather than the shape of the top portion and the pillars and the angle between the top portion and the side portion have a effect upon sound outputting of the piezoelectric electroacoustic transducer in the present disclosure, in particular, the side portion preferably has 4 to 8 pillars.

Figure 22:
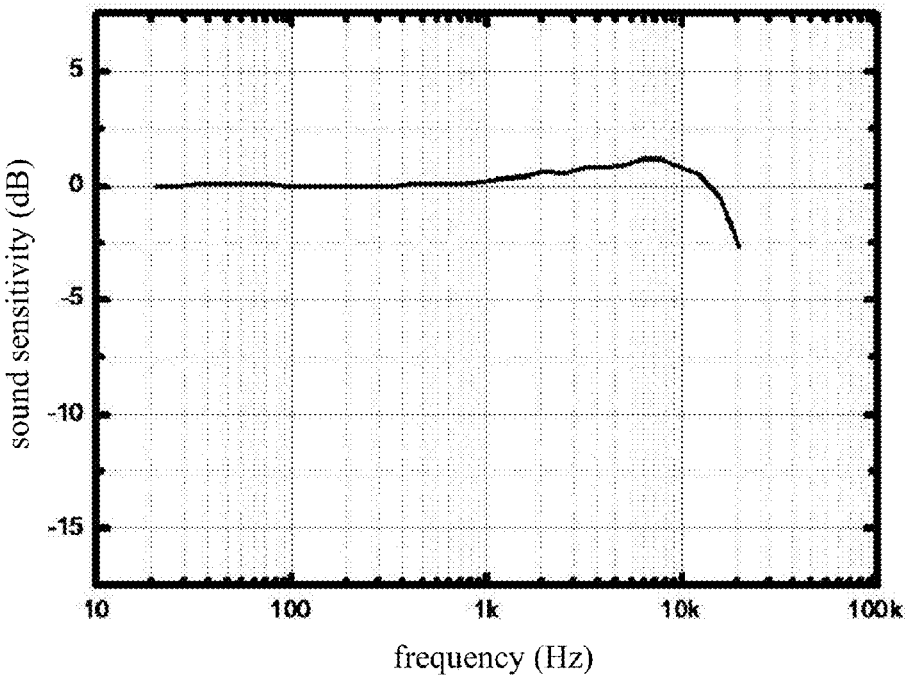
FIG. 22 is a diagram showing a sound sensitivity of a piezoelectric electroacoustic transducer according to the present disclosure.

Furthermore, referring to FIG. 22, the piezoelectric electroacoustic transducer in embodiment 13 may also be implemented as a microphone. A sound receiving testing result for the microphone as illustrated in FIG. 22 shows that, a sound sensitivity of a piezoelectric electroacoustic transducer in most frequency (about 20 Hz to 15 KHz) is within 1 dB. The piezoelectric electroacoustic transducer as a microphone has an excellent electroacoustic converting capability so as to nearly completely convert sound vibrations into voltage signals.

According to the present disclosure, the piezoelectric electroacoustic transducer comprise a piezoelectric element attached to a three-dimensional structure and a membrane covering a gap between pillars of the three-dimensional structure instead of having a fixing frame. It may exhibit a speaker characteristic for high SPL, flat SPL curvature, and low THD, as well as a microphone function for converting sound wave to electronic signal.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A piezoelectric electroacoustic transducer, comprising:

a three-dimensional structure, including a top portion and a side portion integrally connected to the top portion, wherein the side portion has at least a gap;

at least a piezoelectric element provided on the top portion; and at least a membrane covering the at least a gap of the side portion.

2. The piezoelectric electroacoustic transducer of claim 1, wherein the three-dimensional structure is formed to have the top portion and the side portion integrally connected to the top portion by press molding a plate.

3. The piezoelectric electroacoustic transducer of claim 1, wherein the side portion is separated into a plurality of pillars by the at least a gap.

4. The piezoelectric electroacoustic transducer of claim 3, wherein the side portion has 3 to 24 pillars.

5. The piezoelectric electroacoustic transducer of claim 3, wherein the pillar has a width within a range of 2 mm to 6 mm.

6. The piezoelectric electroacoustic transducer of claim 3, wherein the pillar is trapezoid, rectangular, or triangular.

7. The piezoelectric electroacoustic transducer of claim 1, wherein the top portion is rectangular, circular, or elliptical.

8. The piezoelectric electroacoustic transducer of claim 1, wherein the piezoelectric element is rectangular, circular, or elliptical.

9. The piezoelectric electroacoustic transducer of claim 1, wherein the top portion has an inner surface and an outer surface opposing the inner surface, and the piezoelectric element is provided on at least one of the inner surface and the outer surface.

10. The piezoelectric electroacoustic transducer of claim 1, further comprising at least a through hole formed on the top portion, the side portion, or the membrane.

11. The piezoelectric electroacoustic transducer of claim 1, wherein the membrane is made of organic macromolecule and has a thickness within a range of 10 μm to 300 μm.

12. The piezoelectric electroacoustic transducer of claim 1, wherein the three-dimensional structure is made of a metal plate or a sandwich composite consisting of a metal plate, a polymer film and a metal plate in series and having a thickness within a range of 30 μm to 200 μm.

* * * * *